US009840803B2

(12) United States Patent
Kulkarni

(10) Patent No.: US 9,840,803 B2
(45) Date of Patent: Dec. 12, 2017

(54) PUMP ASSEMBLY FOR APPLIANCE

(71) Applicant: General Electric Company, Schenectady, NY (US)

(72) Inventor: Ashutosh Kulkarni, Bangalore (IN)

(73) Assignee: Haier US Appliance Solutions, Inc., Wilmington, DE (US)

( * ) Notice: Subject to any disclaimer, the term of this patent is extended or adjusted under 35 U.S.C. 154(b) by 44 days.

(21) Appl. No.: 14/887,670

(22) Filed: Oct. 20, 2015

(65) Prior Publication Data

US 2017/0107988 A1 Apr. 20, 2017

(51) Int. Cl.

| | |
|---|---|
| ***D06F 37/30*** | (2006.01) |
| ***D06F 39/08*** | (2006.01) |
| ***F04D 15/00*** | (2006.01) |
| ***D06F 33/02*** | (2006.01) |
| ***F04D 15/02*** | (2006.01) |

(52) U.S. Cl.

CPC ..... *D06F 37/304* (2013.01); *D06F 33/02* (2013.01); *D06F 39/087* (2013.01); *F04D 15/0218* (2013.01)

(58) Field of Classification Search

CPC .... D06F 39/087; D06F 39/085; D60F 37/304; F04D 15/0218

See application file for complete search history.

(56) References Cited

U.S. PATENT DOCUMENTS

| | | | | |
|---|---|---|---|---|
| 3,656,866 | A * | 4/1972 | Hine, Jr. | F04D 15/0218 417/38 |
| 4,418,712 | A | 12/1983 | Braley | |
| 5,829,275 | A | 11/1998 | Babuin et al. | |
| 7,064,517 | B2 | 6/2006 | Kiuchi et al. | |
| 8,011,895 | B2 | 9/2011 | Ruffo | |
| 8,702,874 | B2 | 4/2014 | Montgomery et al. | |
| 8,876,980 | B2 | 11/2014 | Poyner et al. | |
| 2005/0158183 | A1* | 7/2005 | Marioni | A47L 15/0047 417/315 |
| 2006/0147327 | A1* | 7/2006 | Ertle | F04D 29/426 417/423.1 |
| 2007/0113595 | A1* | 5/2007 | Harwood | D06F 33/02 68/12.01 |
| 2008/0141465 | A1 | 6/2008 | Muenzner et al. | |
| 2008/0163930 | A1* | 7/2008 | Ha | A47L 15/0031 137/1 |
| 2011/0038736 | A1* | 2/2011 | Hesterberg | A47L 15/0023 417/26 |
| 2013/0047640 | A1 | 2/2013 | Nelson et al. | |
| 2013/0243573 | A1* | 9/2013 | Wang | F04D 15/0218 415/13 |

(Continued)

FOREIGN PATENT DOCUMENTS

| | | | |
|---|---|---|---|
| DE | 69815261 | T2 | 5/2004 |
| EP | 0107234 | A1 | 5/1984 |
| WO | WO2014/071981 | A1 | 5/2014 |

*Primary Examiner* — Joseph L Perrin

(74) *Attorney, Agent, or Firm* — Dority & Manning, P.A.

(57) ABSTRACT

Pump assemblies and methods for operating pump assemblies of appliances are provided. A method includes actuating a motor of the pump assembly to begin operation of a pump of the pump assembly, receiving an electrical signal level between a first electrical contact and a second electrical contact provided for sensing fluid flow through the pump, and deactuating the motor when the electrical signal level falls outside of a predetermined electrical signal range.

12 Claims, 6 Drawing Sheets

(56) References Cited

U.S. PATENT DOCUMENTS

| | | | | |
|---|---|---|---|---|
| 2014/0255155 | A1* | 9/2014 | Liang | F04D 19/02 415/80 |
| 2015/0030429 | A1* | 1/2015 | Abu Al-Rubb | E03F 5/22 415/1 |

* cited by examiner

PUMP ASSEMBLY FOR APPLIANCE

FIELD OF THE INVENTION

The present disclosure relates generally to pump assemblies for appliances, and more particularly to improved sensing of pump assembly operation.

BACKGROUND OF THE INVENTION

Many appliances include pumps for flowing fluid therethrough during operation of the appliance. One example is a washing machine appliance, which includes a pump for draining fluid from a tub of the washing machine appliance. Washing machine appliances generally include a cabinet which supports a tub for containing wash fluid, e.g., water and detergent, bleach and/or other wash additives. A basket is mounted within the tub and defines a wash chamber for receipt of a load of articles for washing. During operation of such washing machine appliances, wash fluid is directed into the tub and onto articles within the wash chamber of the basket. The basket or an agitation element can rotate at various speeds to agitate articles within the wash chamber in the wash fluid, to wring wash fluid from articles within the wash chamber, etc. The fluid can then be drained from the tub, and a pump is typically provided for facilitating such drainage. Another example of an appliance which utilizes a pump is a dishwasher appliance which can utilize a pump for drainage and/or recirculation purposes.

One issue with many presently known pumps is that the pumps generally run continuously during a drain cycle of the appliance. In some cases, insufficient fluid levels may flow through the pump during a portion of the drain cycle. For example, there may be blockage in the system which prevents or reduces fluid flow through the pump, or the amount of fluid to be drained may be low, resulting in a majority of the fluid being flowed through the pump in a faster than expected time period. These situations may result in the pump running "dry" for period of time, which can cause damage to the pump and can utilize excess energy. In some cases, pressure sensors are provided for detecting blockages in the system, but these sensors typically only provide a blockage indication to the user when a full blockage is detected in the appliance.

Accordingly, improved appliance pump operation is desired. In particular, pump assemblies, methods and appliances which facilitate sensing of low fluid flow levels within pumps would be advantageous.

BRIEF DESCRIPTION OF THE INVENTION

Aspects and advantages of the invention will be set forth in part in the following description, or may be obvious from the description, or may be learned through practice of the invention.

In accordance with one embodiment, a pump assembly for an appliance is provided. The pump assembly includes a pump, the pump including a body and an impeller disposed within the body, the body including an inlet portion, an outlet portion, and an impeller portion disposed between the inlet portion and the outlet portion. The pump assembly further includes a motor connected to the impeller for driving the impeller. The pump assembly further includes a sensor assembly for sensing fluid flow through the pump, the sensor assembly including a first electrical contact and a second electrical contact in electrical communication with each other. The pump assembly further includes a controller in communication with the sensor assembly and the motor. The controller is configured for actuating the motor to begin operation of the pump, receiving an electrical signal level between the first electrical contact and the second electrical contact, and deactuating the motor when the electrical signal level falls outside of a predetermined electrical signal range.

In accordance with another embodiment, a washing machine appliance is provided. The washing machine appliance includes a cabinet, a tub positioned within the cabinet, and a basket rotatably mounted within the tub, the basket defining a chamber for receipt of a load of items for washing. The washing machine appliance further includes a pump for draining fluid from the tub. The pump includes a body and an impeller disposed within the body, the body including an inlet portion, an outlet portion, and an impeller portion disposed between the inlet portion and the outlet portion. The washing machine appliance further includes a motor connected to the impeller for driving the impeller. The washing machine appliance further includes a sensor assembly for sensing fluid flow through the pump, the sensor assembly including a first electrical contact and a second electrical contact in electrical communication with each other. The washing machine appliance further includes a controller in communication with the sensor assembly and the motor. The controller is configured for actuating the motor to begin operation of the pump, receiving an electrical signal level between the first electrical contact and the second electrical contact, and deactuating the motor when the electrical signal level falls outside of a predetermined electrical signal range.

In accordance with another embodiment, a method for operating a pump assembly of an appliance is provided. The method includes actuating a motor of the pump assembly to begin operation of a pump of the pump assembly, receiving an electrical signal level between a first electrical contact and a second electrical contact provided for sensing fluid flow through the pump, and deactuating the motor when the electrical signal level falls outside of a predetermined electrical signal range.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
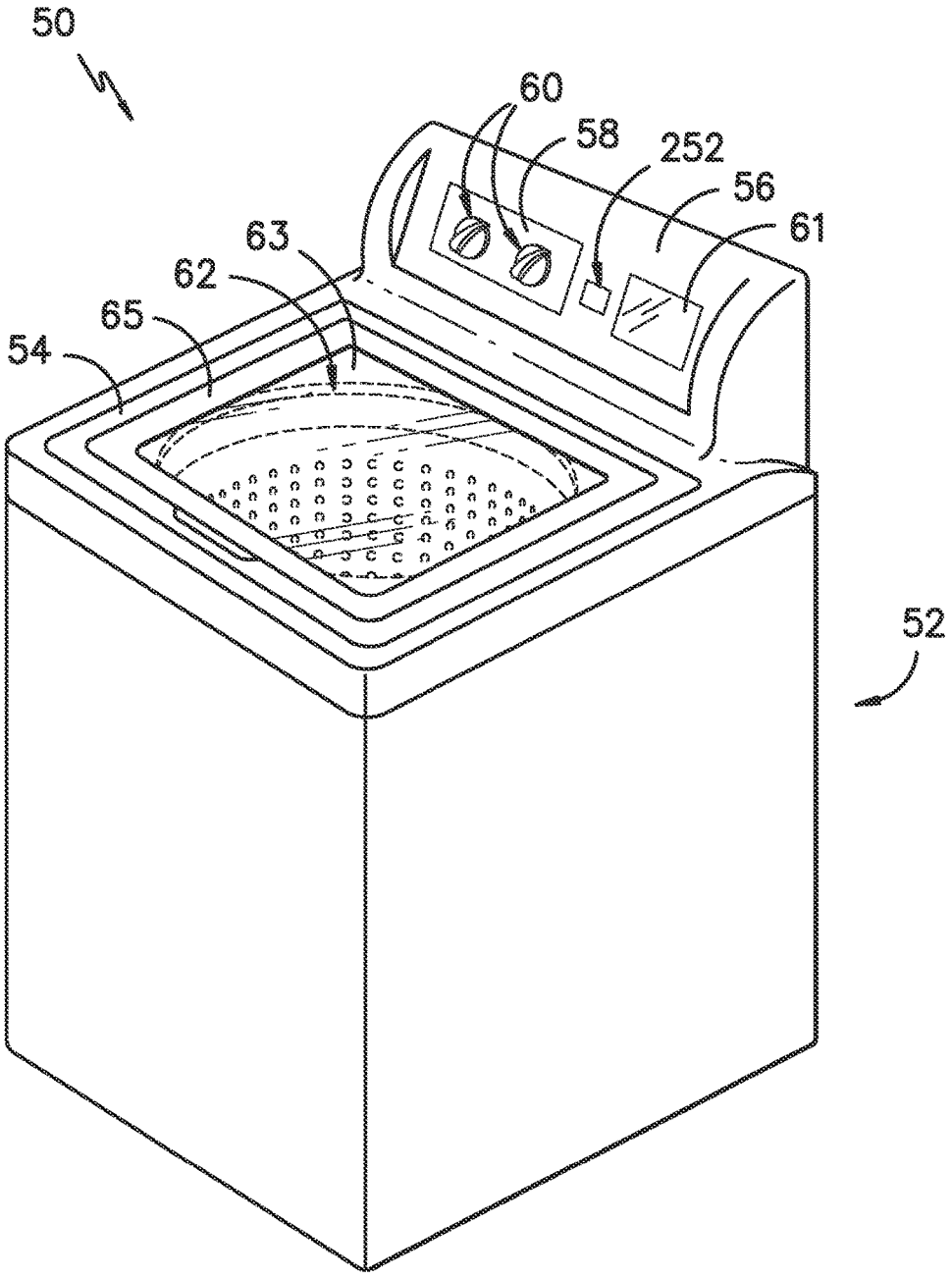
FIG. 1 is a front perspective view of a washing machine appliance with a door in a closed position in accordance with one embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 is a perspective view of a washing machine appliance 50 according to an exemplary embodiment of the present subject matter. As may be seen in FIG. 1, washing machine appliance 50 includes a cabinet 52 and a cover 54. A backsplash 56 extends from cover 54, and a control panel 58 including a plurality of input selectors 60 is coupled to backsplash 56. Control panel 58 and input selectors 60 collectively form a user interface input for operator selection of machine cycles and features, and in one embodiment, a display 61 indicates selected features, a countdown timer, and/or other items of interest to machine users. A door 62 is mounted to cover 54 and is rotatable between an open position (not shown) facilitating access to a wash tub 64 (FIG. 2) located within cabinet 52 and a closed position (shown in FIG. 1) forming an enclosure over tub 64.

Door 62 in exemplary embodiment includes a transparent panel 63, which may be formed of for example glass, plastic, or any other suitable material. The transparency of the panel 63 allows users to see through the panel 63, and into the tub 64 when the door 62 is in the closed position. In some embodiments, the panel 63 may itself generally form the door 62. In other embodiments, the door 62 may include the panel 63 and a frame 65 surrounding and encasing the panel 63. Alternatively, panel 63 need not be transparent.

Figure 2:
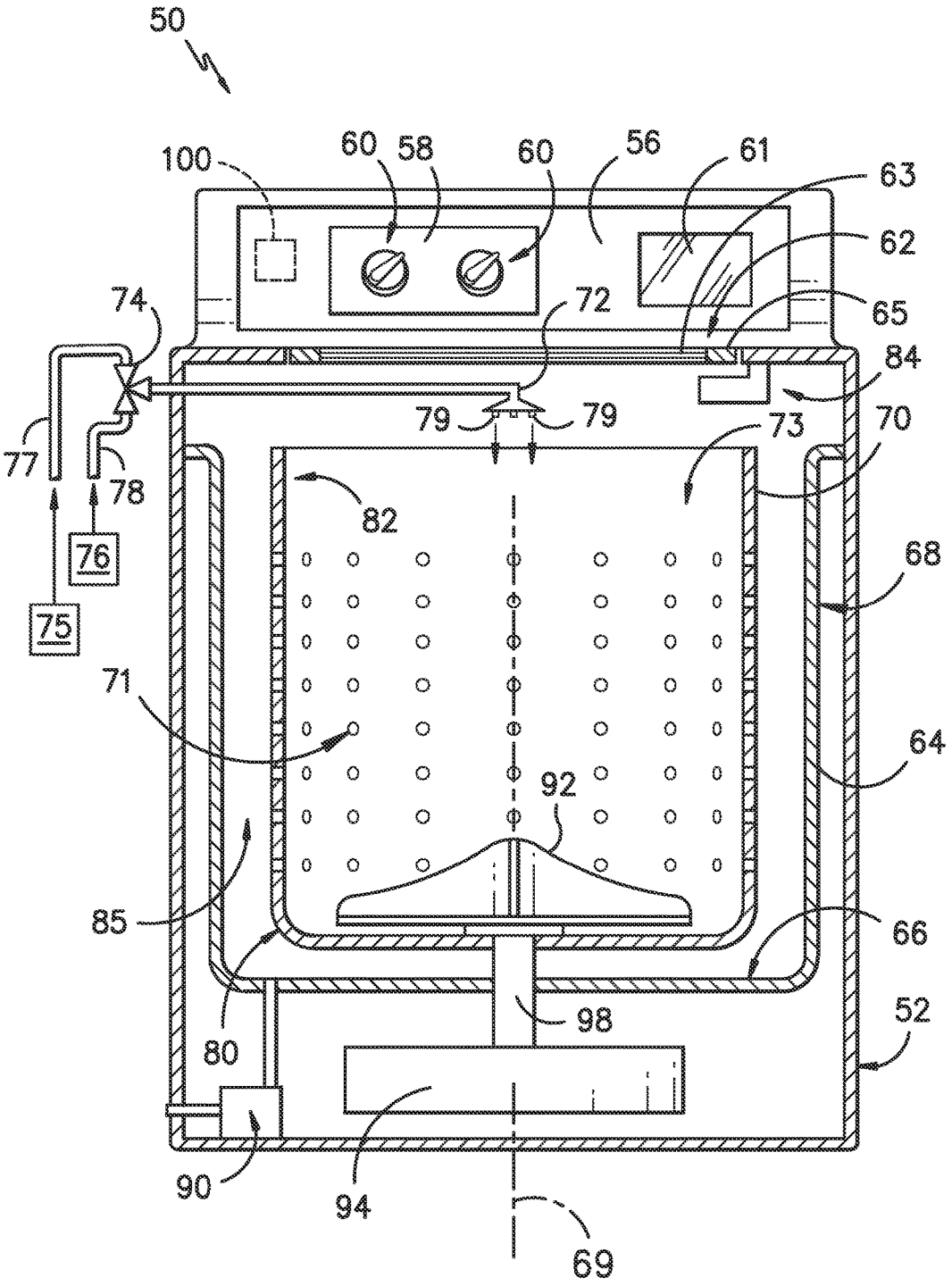
FIG. 2 is a front cross-sectional view of a washing machine appliance in accordance with one embodiment of the present disclosure.
Figure 3:
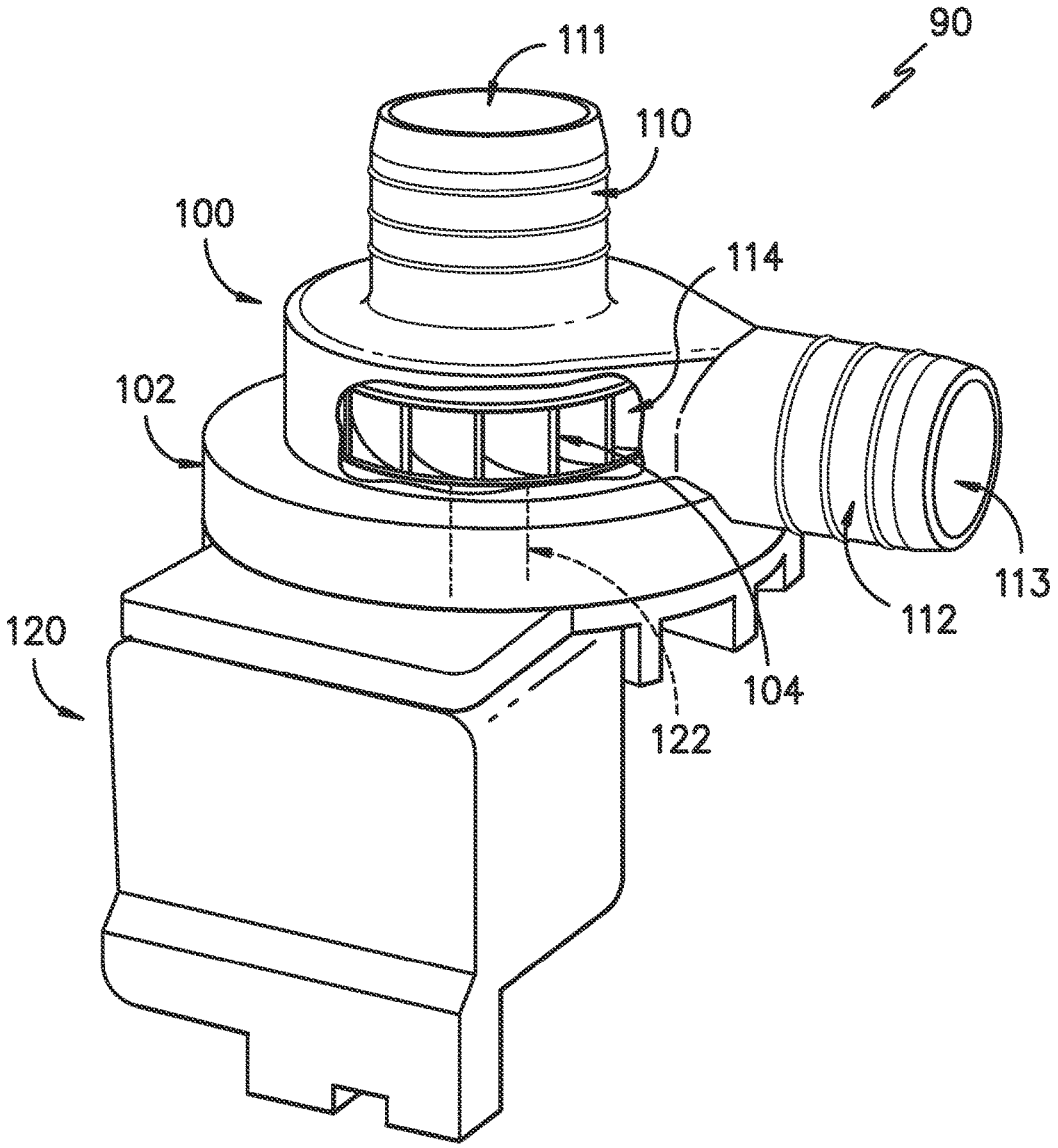
FIG. 3 is a perspective view of a pump assembly in accordance with one embodiment of the present disclosure.

FIG. 2 provides a front, cross-section view of washing machine appliance 50. As may be seen in FIG. 2, tub 64 includes a bottom wall 66 and a sidewall 68. A wash drum or wash basket 70 is rotatably mounted within tub 64, defining an annulus 85 between the tub 64 and basket 70. In particular, basket 70 is rotatable about a central axis 69, which may when properly balanced and positioned in the embodiment illustrated be a vertical axis. Thus, washing machine appliance is generally referred to as a vertical axis washing machine appliance. Basket 70 defines a wash chamber 73 for receipt of a load of articles for washing and extends, e.g., vertically, between a bottom portion 80 and a top portion 82. Basket 70 includes a plurality of openings or perforations 71 therein to facilitate fluid communication between an interior of basket 70 and tub 64.

A nozzle 72 is configured for flowing a liquid into tub 64. In particular, nozzle 72 may be positioned at or adjacent top portion 82 of basket 70. Nozzle 72 may be in fluid communication with one or more water sources 75, 76 in order to direct liquid (e.g. water) into tub 64 and/or onto articles within chamber 73 of basket 70. Nozzle 72 may further include apertures 79 through which water may be sprayed into the tub 64. Apertures 79 may, for example, be tubes extending from the nozzles 72 as illustrated, or simply holes defined in the nozzles 72 or any other suitable openings through which water may be sprayed. Nozzle 72 may additionally include other openings, holes, etc. (not shown) through which water may be flowed, i.e. sprayed or poured, into the tub 64.

A main valve 74 regulates the flow of liquid through nozzle 72. For example, valve 74 can selectively adjust to a closed position in order to terminate or obstruct the flow of liquid through nozzle 72. The main valve 74 may be in fluid communication with one or more external liquid sources, such as a cold water source 75 and a hot water source 76. The cold water source 75 may, for example, be a commercial water supply, while the hot water source 76 may be, for example, a water heater. Such external water sources 75, 76 may supply water to the appliance 50 through the main valve 74. A cold water conduit 77 and a hot water conduit 78 may supply cold and hot water, respectively, from the sources 75, 76 through valve 74. Valve 74 may further be operable to regulate the flow of hot and cold liquid, and thus the temperature of the resulting liquid flowed into tub 64, such as through the nozzle 72.

An additive dispenser 84 may additionally be provided for directing an additive, such as detergent, bleach, liquid fabric softener, etc., into the tub 64. As illustrated, dispenser may be in fluid communication with annulus 85, such that additive added to the dispenser 84 may flow directly from the dispenser 84 into the annulus 85. In alternative embodiments, dispenser may be in fluid communication with nozzle 72 such that water flowing through nozzle 72 flows through dispenser 84, mixing with additive at a desired time during operation to form a liquid or wash fluid, before being flowed into tub 64. In still other alternative embodiments, nozzle 72 and dispenser 84 may be integral, with a portion of dispenser 84 serving as the nozzle 72.

A pump assembly 90 (shown schematically in FIG. 2) is located beneath tub 64 and basket 70 for gravity assisted flow to drain tub 64. An agitation element 92, shown as an impeller in FIG. 2, may be disposed in basket 70 to impart an oscillatory motion to articles and liquid in chamber 73 of basket 70. In various exemplary embodiments, agitation element 92 includes a single action element (i.e., oscillatory only), double action (oscillatory movement at one end, single direction rotation at the other end) or triple action (oscillatory movement plus single direction rotation at one end, singe direction rotation at the other end). As illustrated in FIG. 2, agitation element 92 is oriented to rotate about vertical axis V. Alternatively, basket 70 may provide such agitating movement, and agitation element 92 is not required. Basket 70 and agitation element 92 are driven by a motor 94. Motor 94 may, for example, be a pancake motor, direct drive brushless motor, induction motor, or other motor suitable for driving basket 70 and agitation element 92. As motor output shaft 98 is rotated, basket 70 and agitation element 92 are operated for rotatable movement within tub 64, e.g., about vertical axis V. Washing machine appliance 50 may also include a brake assembly (not shown) selectively applied or released for respectively maintaining basket 70 in a stationary position within tub 64 or for allowing basket 70 to spin within tub 64.

Operation of washing machine appliance 50 is controlled by a processing device or controller 99, that is operatively coupled to the input selectors 60 located on washing machine backsplash 56 (shown in FIG. 1) for user manipulation to select washing machine cycles and features. Controller 99 may further be operatively coupled to various other components of appliance 50, such as main valve 74, pump assembly 90, motor 94, and other suitable sensors, etc. In response to user manipulation of the input selectors 60, controller 99 may operate the various components of washing machine appliance 50 to execute selected machine cycles and features.

Controller 99 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 99 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 58 and other components of washing machine appliance 50, such as the door 62, pump assembly 90, motor 94, valve 74, etc. may be in communication with controller 99 via one or more signal lines or shared communication busses.

In an illustrative embodiment, a load of laundry articles are loaded into chamber 73 of basket 70, and washing operation is initiated through operator manipulation of control input selectors 60. Tub 64 is filled with liquid, such as water, and may be mixed with detergent to form a wash fluid. Main valve 74 can be opened to initiate a flow of liquid and resulting wash fluid into tub 64 via nozzle 72, and tub 64 can be filled to the appropriate level for the amount of articles being washed. Once tub 64 is properly filled with wash fluid, the contents of the basket 70 are agitated with agitation element 92 or by movement of the basket 70 for cleaning of articles in basket 70. More specifically, agitation element 92 or basket 70 is moved back and forth in an oscillatory motion.

After the agitation phase of the wash cycle is completed, tub 64 is drained, such as through use of pump assembly 90. Laundry articles can then be rinsed by again adding fluid to tub 64. Depending on the particulars of the cleaning cycle selected by a user, agitation element 92 or basket 70 may again provide agitation within basket 70. After a rinse cycle, tub 64 is again drained, such as through use of pump assembly 90. Further, in exemplary embodiments, one or more extractions, or spin cycles, may be performed. In particular, a spin cycle may be applied after the wash cycle(s) and/or after the rinse cycle(s) in order to wring excess wash fluid from the articles being washed. During a spin cycle, basket 70 is rotated at relatively high speeds, as discussed further herein.

While described in the context of specific embodiments of washing machine appliance 50, using the teachings disclosed herein it will be understood that washing machine appliance 50 is provided by way of example only. Other washing machine appliances having different configurations (such as horizontal-axis washing machine appliances), different appearances, and/or different features may also be utilized with the present subject matter as well.

It should further be understood that an appliance in accordance with the present disclosure is not limited to a washing machine appliance. Any suitable appliance which utilizes a pump for flowing fluid therethrough, such as for example a dishwasher appliance, is within the scope and spirit of the present disclosure.

Referring now to FIGS. 3 through 6, embodiments of pump assemblies 90 for use in appliances 50 are provided. In general, a pump assembly 90 in accordance with the present disclosure may include a pump 100 for flowing fluid therethrough, such as for drainage as discussed above, for recirculation, or for another suitable use. Advantageously, a pump assembly 90 in accordance with the present disclosure may further include apparatus for sensing fluid flow levels through the pump assembly 90, and for operating the pump assembly 90 accordingly.

As shown, pump 100 may include a body 102 and an impeller 104. The impeller 104 may be disposed within an interior 106 of the body 102, and may be rotatable to direct fluid (i.e. wash fluid, which in exemplary embodiments includes a liquid) flow therepast. Body 102 may include an inlet portion 110 (which may define an inlet 111 of the body 102), an outlet portion 112 (which may define an outlet 113 of the body 102), and an impeller portion 114 (in which the impeller 104 is disposed) between the inlet and outlet portions 110, 112. Fluid may flow into the inlet portion 110 through the inlet 111, from the inlet portion 110 to the impeller portion 114, past the impeller 104 and into the outlet portion 112, and from the outlet portion 112 through the outlet 113.

Pump assembly 90 may additionally include a motor 120 (which may for example be motor 94 or be separate from motor 94). The motor 120 may drive the impeller 104 and thus operate the pump 100. Actuation of the motor 120 may operate the pump 100 may causing rotation of the impeller 104, and deactuation of the motor 120 may stop operation of the pump 100 (and impeller 104 thereof). Motor 120 may be connected, such as via a shaft 122) to the impeller 104 for driving the impeller 104.

Pump assembly 90 may further include a sensor assembly 130 for sensing fluid through the pump 100. Sensor assembly 130 may include a first electrical contact 132 and a second electrical contact 134, and may further include a third or more electrical contacts. The contacts 132, 134 may be in electrical communication with each other, such that there is an electrical signal, such as a voltage, current, and/or capacitance, between the contacts 132, 134 that can be measured. For example, the contacts 132, 134 may be connected to a power source and to each other.

Figure 4:
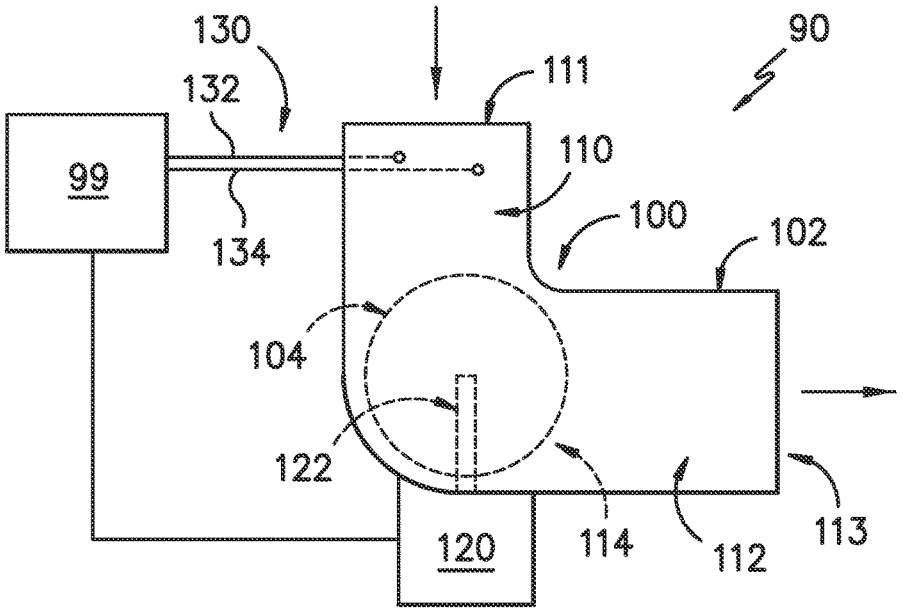
FIG. 4 is a schematic top view of a pump assembly in accordance with one embodiment of the present disclosure.
Figure 5:
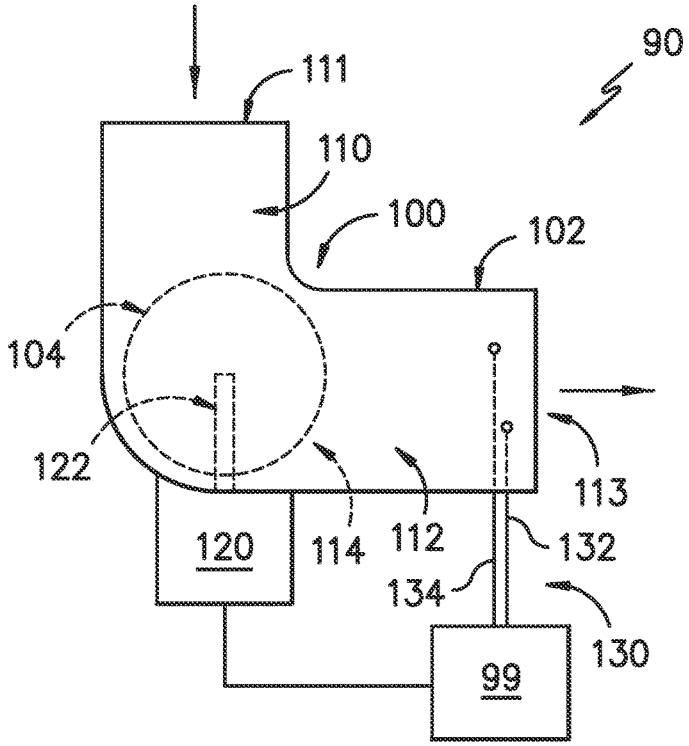
FIG. 5 is a schematic top view of a pump assembly in accordance with another embodiment of the present disclosure.

In exemplary embodiments, the contacts 132, 134 may be formed from steel, such as a stainless steel, or another suitable metal. Alternatively, other suitable conductive materials may be utilized. The contacts 132, 134 may, in exemplary embodiments, be disposed within the body 102, such as in the interior 106. In some embodiments, as illustrated in FIG. 4, the contacts 132, 134 may be disposed within the inlet portion 110. In other embodiments, as illustrated in FIG. 5, the contacts 132, 134 may be disposed within the outlet portion 112. In still other embodiments, the contacts 132, 134 may be disposed within the impeller portion 104. Alternatively, the contacts 132, 134 may be disposed upstream or downstream of the pump 100 in the flow path of fluid through the pump 100, such as in a conduit connected to the pump 100 for flowing fluid to or from the pump 100.

Figure 6:
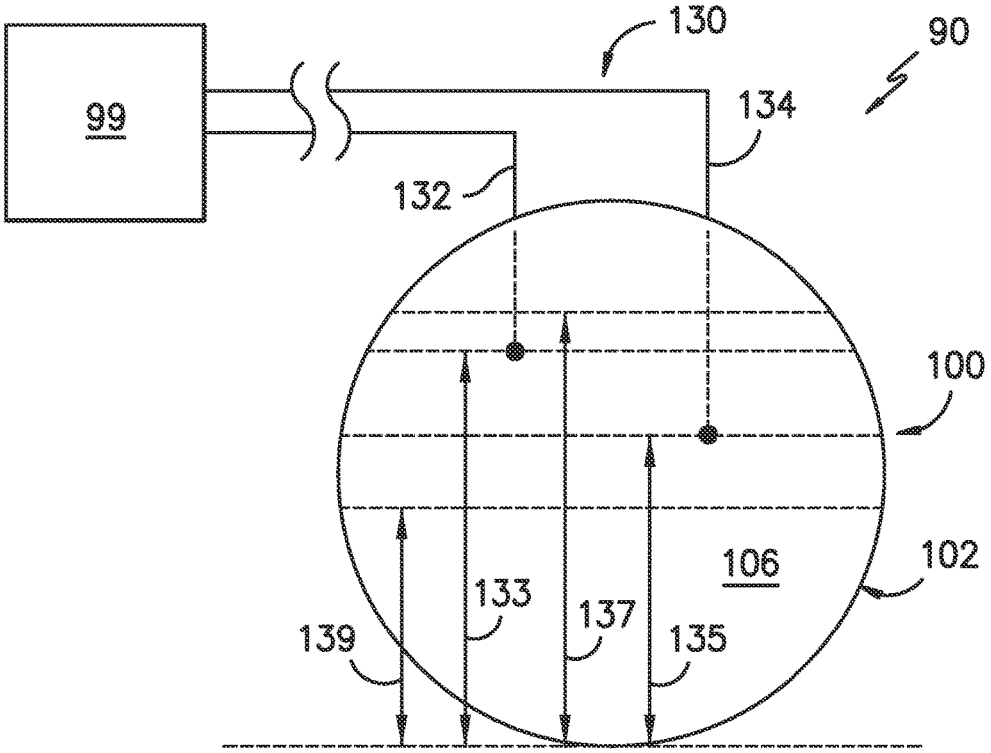
FIG. 6 is a schematic cross-sectional view of a pump assembly in accordance with one embodiment of the present disclosure.

Referring to FIG. 6, the contacts 132, 134 may be disposed within the interior 104 of pump 100 at suitable height- or width-wise locations spaced from the inner surface of the body 102. For example, a height within the interior 104 of the pump 100 may be measured along a vertical direction V from the inner surface of the body 102, such as from a low-point of the inner surface of the body 102. As shown, contacts 132 and 134, such as the ends thereof, may be at heights 133, 135 respectively, which may be identical or different heights. Accordingly, when a typical fluid flow through the pump 100 is occurring, the contacts 132, 134 may be submerged in the fluid, as shown for example by fluid at height 137. When the contacts 132, 134 are both submerged, the electrical signal between the contacts 132, 134 may increase or decrease (depending on the type of signal being measured), such as to outside of a predetermined electrical signal range as discussed herein. When fluid flow has stopped, the fluid level within the pump 100 may drop such that one or both contacts 132, 134 are no longer submerged. For example, fluid may be at height 139. In this case, the electrical signal between the contacts 132, 134 may decrease or increase, such as to within the predetermined electrical signal range as discussed herein. Such electrical signal changes can thus advantageously be utilized to monitor fluid flow through the pump assembly 90 and operate the pump 100 accordingly.

Pump assembly 90 may additionally include a controller, such as controller 99 as discussed above. The controller 99 may generally be in communication with other components of the pump assembly 90, such the sensor assembly 130 (i.e. the first and second contacts 132, 134) and the motor 120. As discussed herein, controller 99 may in exemplary embodiments advantageously be configured to control operation of the pump assembly 90 based on inputs from the contacts 132, 134.

Figure 7:
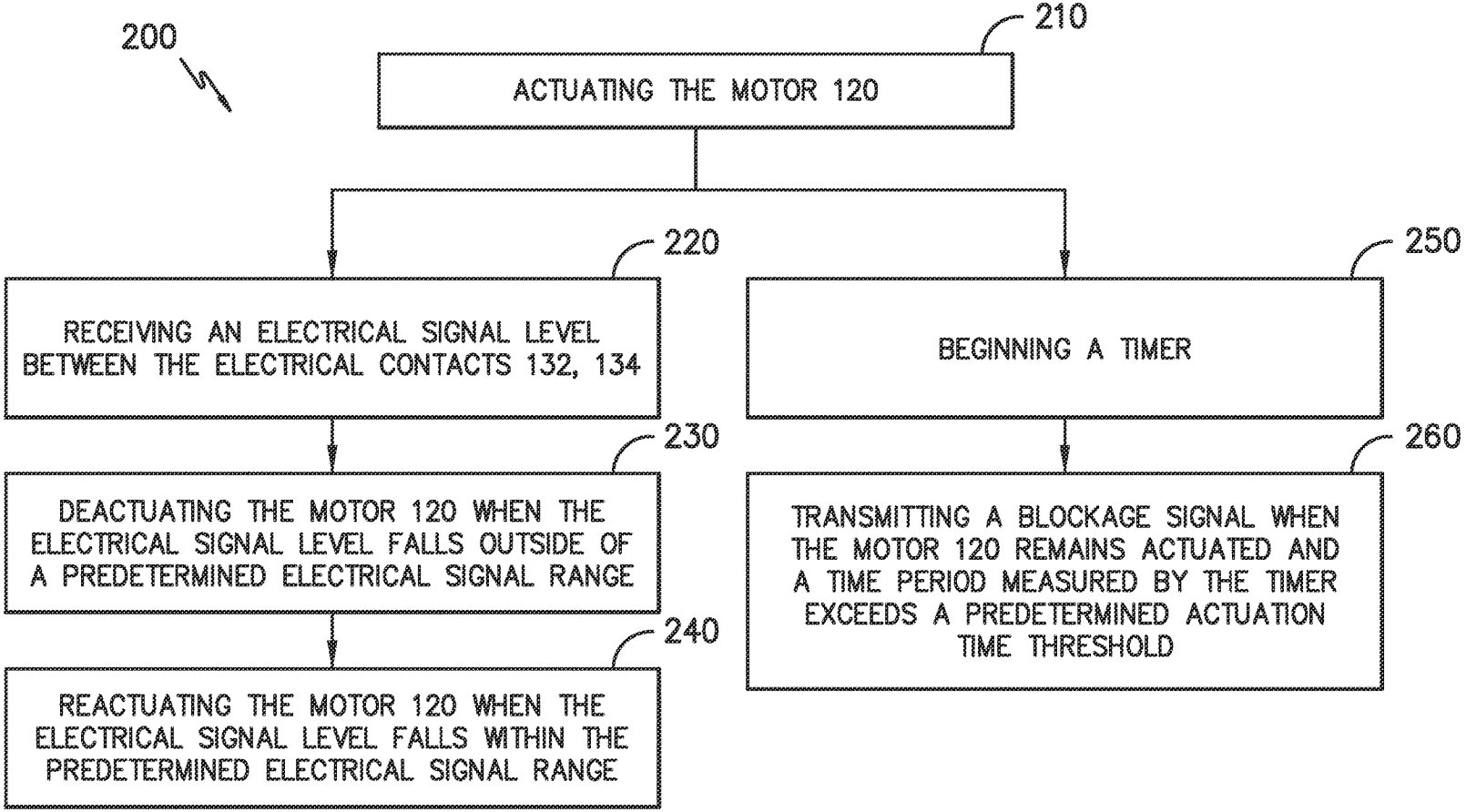
FIG. 7 is a flow chart illustrating a method in accordance with one embodiment of the present disclosure.

Referring now to FIG. 7, the present disclosure is further directed to methods 200 for operating pump assemblies 90 of appliances. In general, the various steps of methods as disclosed herein may in exemplary embodiments be performed by the controller 99, which may receive inputs and transmit outputs from various other components of the appliance 50 as discussed herein. Such operation of pump assemblies 90 in accordance with the present disclosure may advantageously facilitate reductions in time periods during which the pump 100 is run dry, thus reducing the risk of damage to the pump 100 and reducing the energy usage of the pump assembly 90 generally.

A method 200 may, for example, include the step 210 of actuating the motor 120 to begin operation of the pump 100. When actuated, the motor 120 may operate to rotate the impeller 104, thus operating the pump 100 generally to encourage fluid flow therethrough. Such operation may continue until the motor 120 is deactuated. Actuation 210 may occur, for example, at the beginning of a drain cycle of the appliance 50 or during another suitable cycle during operation of the appliance 50. Further, such actuation 210 may occur for a predetermined time period, or may occur for an unspecified time period that may terminate due to operation of the sensor assembly 130 and resulting motor 120 deactuation as discussed herein.

Method 200 may further include, for example, the step 220 of receiving an electrical signal level between the first electrical contact 132 and the second electrical contact 134. Such receiving step 220 may occur during operation of the pump 100 after actuation 210 occurs. For example, a signal associated with an electrical level (i.e. voltage, current, capacitance, etc.) may be transmitted to the controller 99, which may receive such signal. In exemplary embodiments, the receiving step 220 may occur repeatedly at a predetermined time interval during operation of the pump 100. The predetermined time interval may, for example, be between 1 and 30 seconds, such as between 1 and 20 seconds, such as between 2 and 10 seconds, such as between 3 and 5 seconds.

As discussed, during operation of the pump 100, the electrical signal level may fall outside or inside of a predetermined electrical signal range based on the level of fluid flow through the pump 100. Accordingly, method 200 may further include, for example, the step 230 of deactuating the motor 120, thus terminating operation of the pump 100 to encourage flow therethrough, when the electrical signal level falls outside of the predetermined electrical signal range. Such step may advantageously reduce instances of the impeller 104 running dry, thus reducing the risk of damage to the impeller 104 and pump 100 generally. When the actuation 210 has been set for a predetermined time period, such deactuation 230 may occur within the predetermined time period to prevent running dry during, for example, an end portion of the predetermined time period when operation of the pump 100 is no longer necessary.

Notably, when the electrical signal level remains within the predetermined electrical signal range after actuation 210, pump 100 may continue to operate.

In exemplary embodiments, the motor 120 may be deactuated in step 230 after a predetermined delay time period when the electrical signal level remains outside of the predetermined electrical signal range. Accordingly, when the electrical signal level falls outside of the predetermined electrical signal range, the motor 120 may continue to operate, and deactuation may not occur, for a predetermined delay time period. If the electrical signal level remains outside of the predetermined electrical signal range during the predetermined delay time period, the motor 120 may be deactuated after the predetermined delay time period has expired. The predetermined delay time period may, for example, be between 1 and 30 seconds, such as between 1 and 20 seconds, such as between 2 and 10 seconds, such as between 3 and 5 seconds. Further, in exemplary embodiments, the predetermined delay time period may be equal to the predetermined time interval.

In some embodiments, method 200 may further include, for example, the step 240 of reactuating the motor 120 to operate the pump 100. Such step 240 may, for example, occur when the electrical signal level falls within the predetermined electrical signal range after, for example, deactuation 230 has occurred (such as within the predetermined time period for pump 100 operation). For example, such step 240 may occur when the electrical signal level falls within the predetermined electrical signal range within the predetermined delay time period. Accordingly, operation of the pump 100 may resume when the fluid level therein is again sufficient for pump 100 operation.

Notable, in exemplary embodiments, the predetermined electrical signal range may include and be determined based on a predetermined electrical signal threshold. In some embodiments, electrical signals above the threshold may be within the range and electrical signals below the threshold may be outside of the range. Alternatively, electrical signals below the threshold may be within the range and electrical signals above the threshold may be outside of the range. In some exemplary embodiments, for example, the electrical signal level is a voltage level. Voltage levels above a predetermined voltage threshold may be considered within the range, and voltage levels below the predetermined voltage threshold may be considered outside of the range. Alternatively, other suitable electrical signals, such as current or capacitance, may be measured and utilized in accordance with the present disclosure.

In some embodiments, method 200 may further include, for example, the step 250 of beginning a timer upon actuation of the motor 120 in step 210. The timer may, for example, be integrated into the controller 99. Method 200 may further include, for example, the step 260 of transmitting a blockage signal when the motor 120 remains actuated (and the pump 100 thus continues to operate) and a time period measured by the timer exceeds a predetermined actuation time threshold. Such step 260 may, for example, occur when the deactuating step 230 has not occurred during the time period measured by the timer and the time period exceeds the predetermined actuation time threshold. When the time period exceeds the predetermined actuation time threshold, this may indicate that a partial or full blockage exists in the pump 100 which is preventing fluid from sufficiently flowing through the pump 100. The blockage signal thus indicates to the user that a blockage may exist, and allows the user to determine if a blockage indeed exists and to remove the blockage if necessary.

In some embodiments, the signal is transmitted to a signal output device 252 of the appliance 50, which may for example, be included in the control panel 58. For example, the signal output device 252 may be a portion of the display 61, or may be a separate device 252 devoted to providing an output for the signal 202. The signal output device 252 may emit an alert when the signal is received. The alert may, for example, be auditory and/or visual. Accordingly, the device 252 may, for example, be a speaker or a light.

Notably, in exemplary embodiments, the various time thresholds and electrical signal ranges as discussed herein may be stored in the controller 99. In some embodiments, the thresholds and ranges may be user adjustable (i.e. via control panel 58 and input selectors 60). Additionally or alternatively, the thresholds and ranges may be calibrated based on an initial operation of the appliance 50, such as upon installation or after a loss of power. For example, the predetermined actuation time threshold may be calibrated based on the time period measured during an initial operation of the appliance 50, with the assumption that no blockage exists during this operation. Accordingly, methods and apparatus in accordance with the present disclosure may advantageously be utilized with a wide variety of drain pipe heights, and are calibrated for any particular drain pipe height, pump flow, etc.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A pump assembly for an appliance, the pump assembly comprising:

a pump, the pump comprising a body and an impeller disposed within the body, the body comprising an inlet portion, an outlet portion, and an impeller portion disposed between the inlet portion and the outlet portion;

a motor connected to the impeller for driving the impeller;

a sensor assembly for sensing fluid flow through the pump, the sensor assembly comprising a first electrical contact and a second electrical contact in electrical communication with each other; and a controller in communication with the sensor assembly and the motor, the controller configured to initiate:

actuating the motor to begin operation of the pump;

receiving an electrical signal level between the first electrical contact and the second electrical contact;

determining a predetermined delay time has elapsed in response to the first electrical signal level falling outside of a predetermined electrical signal range, the predetermined delay time being between 1 and 30 seconds;

receiving a subsequent electrical signal between the first electrical contact and the second electrical contact upon determining the predetermined delay time has elapsed; and deactuating the motor when the subsequent electrical signal level falls outside of the predetermined electrical signal range.

2. The pump assembly of claim 1, wherein the controller is further configured to initiate:

reactuating the motor when the electrical signal level falls within the predetermined electrical signal range within the predetermined delay time period after deactuating the motor.

3. The pump assembly of claim 1, wherein the step of receiving the electrical signal level occurs repeatedly at a predetermined time interval.

4. The pump assembly of claim 3, wherein the predetermined delay time period is equal to the predetermined time interval.

5. The pump assembly of claim 1, wherein the controller is further co configured to initiate:

beginning a timer upon actuation of the motor; and transmitting a blockage signal when the motor remains actuated and a time period measured by the timer exceeds a predetermined actuation time threshold.

6. The pump assembly of claim 1, wherein the motor is actuated for a predetermined time period.

7. The pump assembly of claim 1, wherein the first electrical contact and the second electrical contact are disposed within the body.

8. The pump assembly of claim 7, wherein the first electrical contact and the second electrical contact are disposed within the inlet portion.

9. The pump assembly of claim 7, wherein the first electrical contact and the second electrical contact are disposed within the outlet portion.

10. A washing machine appliance, comprising:

a cabinet;

a tub positioned within the cabinet;

a basket rotatably mounted within the tub, the basket defining a chamber for receipt of a load of items for washing;

a pump for draining fluid from the tub, the pump comprising a body and an impeller disposed within the body, the body comprising an inlet portion, an outlet portion, and an impeller portion disposed between the inlet portion and the outlet portion;

a motor connected to the impeller for driving the impeller;

a sensor assembly for sensing fluid flow through the pump, the sensor assembly comprising a first electrical contact and a second electrical contact in electrical communication with each other; and a controller in communication with the sensor assembly and the motor, the controller configured to initiate:

actuating the motor to begin operation of the pump;

receiving an electrical signal level between the first electrical contact and the second electrical contact;

determining a predetermined delay time has elapsed in response to the first electrical signal level falling outside of a predetermined electrical signal range, the predetermined delay time being between 1 and 30 seconds;

receiving a subsequent electrical signal between the first electrical contact and the second electrical contact upon determining the predetermined delay time has elapsed; and deactuating the motor when the subsequent electrical signal level falls outside of the predetermined electrical signal range.

11. The washing machine appliance of claim 10, wherein the motor is deactuated after a predetermined delay time period when the electrical signal level remains outside of the predetermined electrical signal threshold.

12. The washing machine appliance of claim 10, wherein the controller is further configured to initiate:

beginning a timer upon actuation of the motor; and transmitting a blockage signal when the motor remains actuated and a time period measured by the timer exceeds a predetermined actuation time threshold.

* * * * *